US007780404B2

(12) United States Patent
Horng et al.

(10) Patent No.: US 7,780,404 B2
(45) Date of Patent: Aug. 24, 2010

(54) FAN HOUSING WITH NOISE-REDUCING STRUCTURE

(75) Inventors: Alex Horng, Kaohsiung (TW); Mei-Chih Fang, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 800 days.

(21) Appl. No.: 11/706,975

(22) Filed: Feb. 16, 2007

(65) Prior Publication Data

US 2008/0152479 A1 Jun. 26, 2008

(30) Foreign Application Priority Data

Dec. 26, 2006 (TW) ..... 95148962 A

(51) Int. Cl.
*F04D 29/54* (2006.01)

(52) U.S. Cl. ..... 415/191; 415/208.2; 415/211.1; 415/213.1; 415/220; 415/176

(58) Field of Classification Search ..... 415/102, 415/214.1, 205, 206, 176, 191, 208.1, 208.2, 415/211.1, 213.1, 220
See application file for complete search history.

(56) References Cited

U.S. PATENT DOCUMENTS 5,335,722 A * 8/1994 Wu ..... 165/122
5,522,700 A * 6/1996 Hong ..... 415/177
5,526,875 A * 6/1996 Lin ..... 165/80.3
5,967,747 A 10/1999 Burke et al.
6,254,343 B1 7/2001 Schmidt et al.
6,386,276 B1 * 5/2002 Chen et al. ..... 165/121
6,514,036 B2 2/2003 Marshall et al.
6,561,762 B1 * 5/2003 Horng et al. ..... 415/211.2
6,579,064 B2 * 6/2003 Hsieh ..... 416/182
6,681,845 B1 * 1/2004 Yeh et al. ..... 165/122
6,710,486 B1 3/2004 Horng et al.
6,964,556 B2 * 11/2005 Chiu et al. ..... 415/205
7,157,819 B2 * 1/2007 Matsumoto ..... 310/67 R
2006/0073043 A1 * 4/2006 Lee et al. ..... 417/423.14

* cited by examiner

*Primary Examiner*—Igor Kershteyn
(74) *Attorney, Agent, or Firm*—Muncy, Geissler, Olds, & Lowe, PLLC

(57) ABSTRACT

A fan housing with a noise-reducing structure includes a housing having a side wall. An air inlet is defined in the housing and an air outlet defined in the side wall of the housing. A plurality of supporting ribs are disposed in the air inlet and connected between inner and outer peripheries of the air inlet for supporting a motor base. At least one of the supporting ribs is adjacent to the air outlet and extends in a direction coincident to or intersects with a longitudinal line of the air outlet extending through a rotational axis of the motor base.

6 Claims, 4 Drawing Sheets

FAN HOUSING WITH NOISE-REDUCING STRUCTURE

BACKGROUND OF THE INVENTION

1. Field of the Invention

The present invention relates to a fan casing with a noise-reducing structure. In particular, the present invention relates to a fan housing including an air inlet and an air outlet, with a supporting rib arranged in the air inlet extending along a longitudinal direction of the air outlet to reduce noise during operation.

2. Description of Related Art

A conventional fan, as illustrated in FIG. 1 of the drawings, includes a housing 10 in which an impeller 20 is rotatably received for creating an airflow when the impeller 20 is turned. The housing 10 includes an air inlet 11 and an air outlet 12. The airflow enters the housing 10 via the air inlet 11 and exits the housing 10 via the air outlet 12. The air inlet 11 is in a top side or bottom side of the housing 10 whereas the air outlet 12 is in a lateral side of the housing 10.

With reference to FIG. 1, a plurality of supporting ribs 111 are provided in the air inlet 11 and connected between an inner periphery of the air inlet 11 and an outer periphery of the air inlet 11 to support a motor base 112. To support the motor base 112 in a balanced manner, at least three supporting ribs 111 are provided. At lease one of the supporting ribs 111 is located in an area A (between two parallel, spaced lines in FIG. 1) adjacent to the air outlet 12 for balanced support of the motor base 112.

Although the supporting ribs 111 provide balanced support for the motor base 112, the supporting ribs 111 in the area "A" interfere with the airflow from the air inlet 11 to the air outlet 12. During operation of the motor, greater noise is generated at the supporting ribs 111 in the area A when the impeller 20 turns. Therefore, there is a need in improving disposition of the supporting ribs 111 to reduce the noise generated during operation.

OBJECTS OF THE INVENTION

An object of the present invention is to provide a fan housing with a noise-reducing structure by providing at least one supporting rib in the air inlet and adjacent to the air outlet, wherein the supporting rib adjacent to the air outlet extends along a longitudinal line of the air outlet extending through a rotational axis of the motor base.

Another object of the present invention is to provide a fan housing with a noise-reducing structure by providing at least one supporting rib in the air inlet and adjacent to the air outlet, wherein the supporting rib adjacent to the air outlet extends in a direction at an inclination angle to a longitudinal line of the air outlet extending through a rotational axis of the motor base.

A further object of the present invention is to provide a fan housing with a noise-reducing structure by providing at least one supporting rib in the air inlet and adjacent to the air outlet, wherein the supporting rib adjacent to the air outlet has a width smaller than that of the remaining supporting ribs.

SUMMARY OF THE INVENTION

To achieve the aforementioned objects, the present invention provides a fan housing with a noise-reducing structure including a housing having a side wall. An air inlet is defined in the housing and an air outlet defined in the side wall of the housing. A plurality of supporting ribs are disposed in the air inlet and connected between inner and outer peripheries of the air inlet for supporting a motor base. At least one of the supporting ribs is adjacent to the air outlet and extends in a direction coincident to or intersects with a longitudinal line of the air outlet extending through a rotational axis of the motor base.

In an embodiment, the supporting rib adjacent to the air outlet extends along the longitudinal line in parallel.

In another embodiment, the supporting rib adjacent to the air outlet extends in a direction at an inclination angle to the longitudinal line. Preferably, the inclination angle is ±40 degrees.

In a further embodiment, the supporting rib adjacent to the air outlet has a width smaller than that of the remaining supporting ribs.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
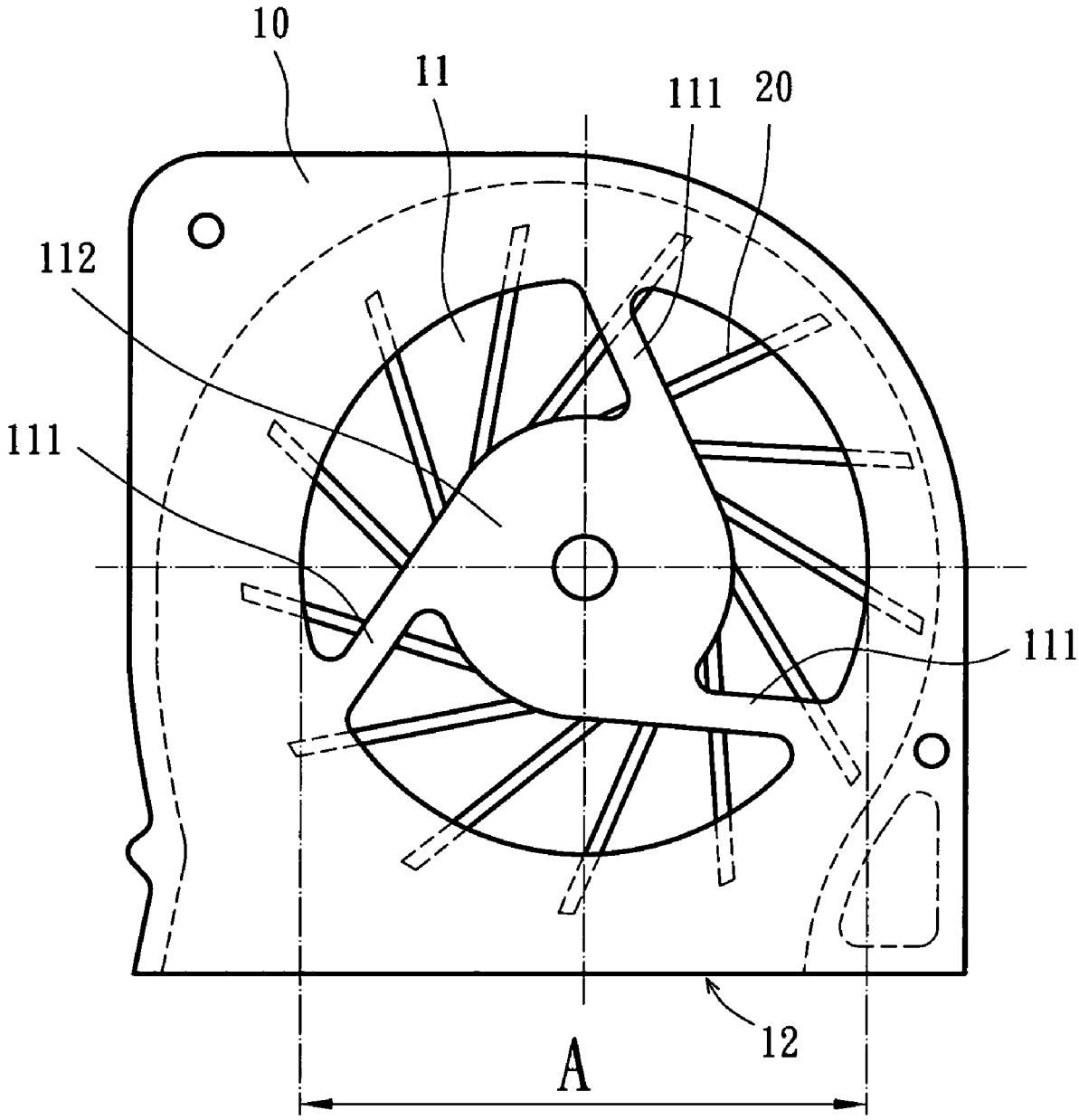
FIG. 1 PRIOR ART
FIG. 1 is a top plan view of a conventional fan.

Preferred embodiments of the present invention are now to be described hereinafter in detail, in which the same reference numerals are used in the preferred embodiments for the same parts as those in the prior art to avoid redundant description.

Figure 2:
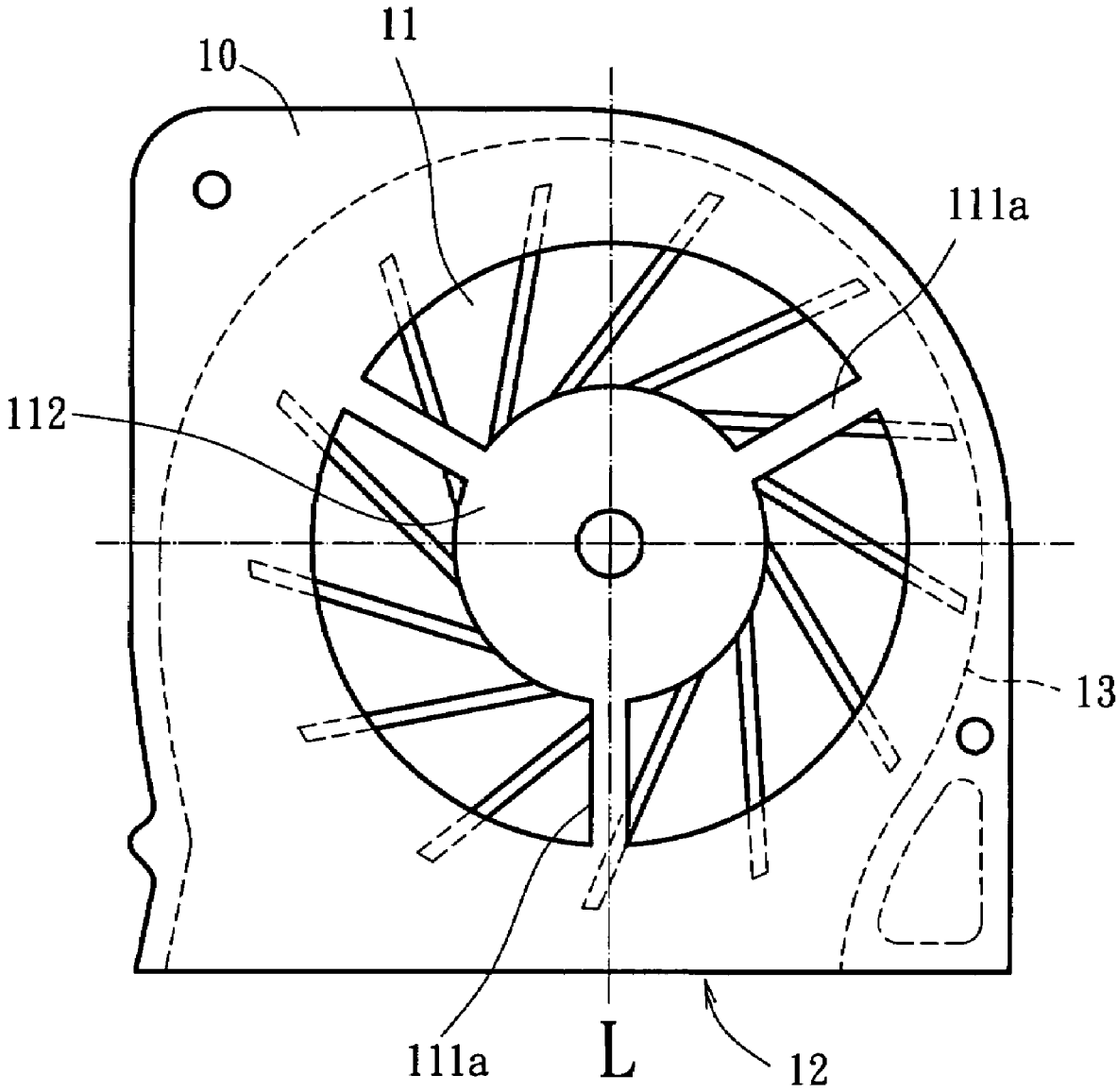
FIG. 2 is a top plan view of a first embodiment of a fan housing in accordance with the present invention.

FIG. 2 is a top plan view of a first embodiment of a fan housing 10 in accordance with the present invention. The housing 10 is made of metal or non-metal material such as plastic. An impeller 20 is rotatably received in the housing 10. An airflow is created when the impeller 20 is turned. The housing 10 includes at least one inlet 11 in a side thereof and at least one air outlet 12 in another side thereof. The airflow entering the housing 10 via the air inlet 11 flows in an axial direction of a rotational shaft (not labeled) of the impeller 20 and then exits the housing 10 via the air outlet 12 in a direction perpendicular to an axial direction of the housing 10 (or the axial direction of the impeller 20). The air inlet 11 is in a top side or bottom side of the housing 10. In a case that the housing 10 includes two air inlets 11, the air outlet 12 is in a side wall 13 extending in a horizontal direction.

With reference to FIG. 2, a plurality of supporting ribs 111*a* are provided in the air inlet 11 and connected between an inner periphery of the air inlet 11 and an outer periphery of the air inlet 11 to support a motor base 112. In the embodiment shown, three supporting ribs 111*a* are provided to support the motor base 112 in a balanced manner. At least one of the supporting ribs 111*a* is designated to be disposed in an area adjacent to the air outlet 12. In this embodiment, the designated supporting rib 111*a* extends in a direction coincident to or intersects with a longitudinal direction of the air outlet 12 (see the reference line L passing through the rotational axis of the motor base 112) such that the designated supporting rib 111*a* is aligned with the longitudinal direction. By disposing the supporting rib 111*a* adjacent to the air outlet 12 along the longitudinal line L, the noise generated during operation of the housing 10 can be effectively reduced. Preferably, the supporting ribs 111*a* have identical shape and size.

In the first embodiment shown in FIG. 2, the supporting rib 111*a* adjacent to the air outlet 12 extends along the longitudinal line L in parallel, and has a lengthwise direction directed to the air outlet 12. The airflow passes through two sides of this supporting rib 111*a* and creates balanced pressure before reaching the air outlet 12. Thus, balanced airflow is generated and operational noise is reduced. Finally, the airflow exits the housing 10 via the air outlet 12.

This supporting rib 111*a* not only assists in supporting the motor base 112 in a balanced manner but reduces disturbance to the airflow flowing from the air inlet 11 to the air outlet 12 by disposing this supporting rib 111*a* in an appropriate location. When the motor operates, the operational noise is, thus, effectively reduced when the impeller 20 turns.

Figure 3:
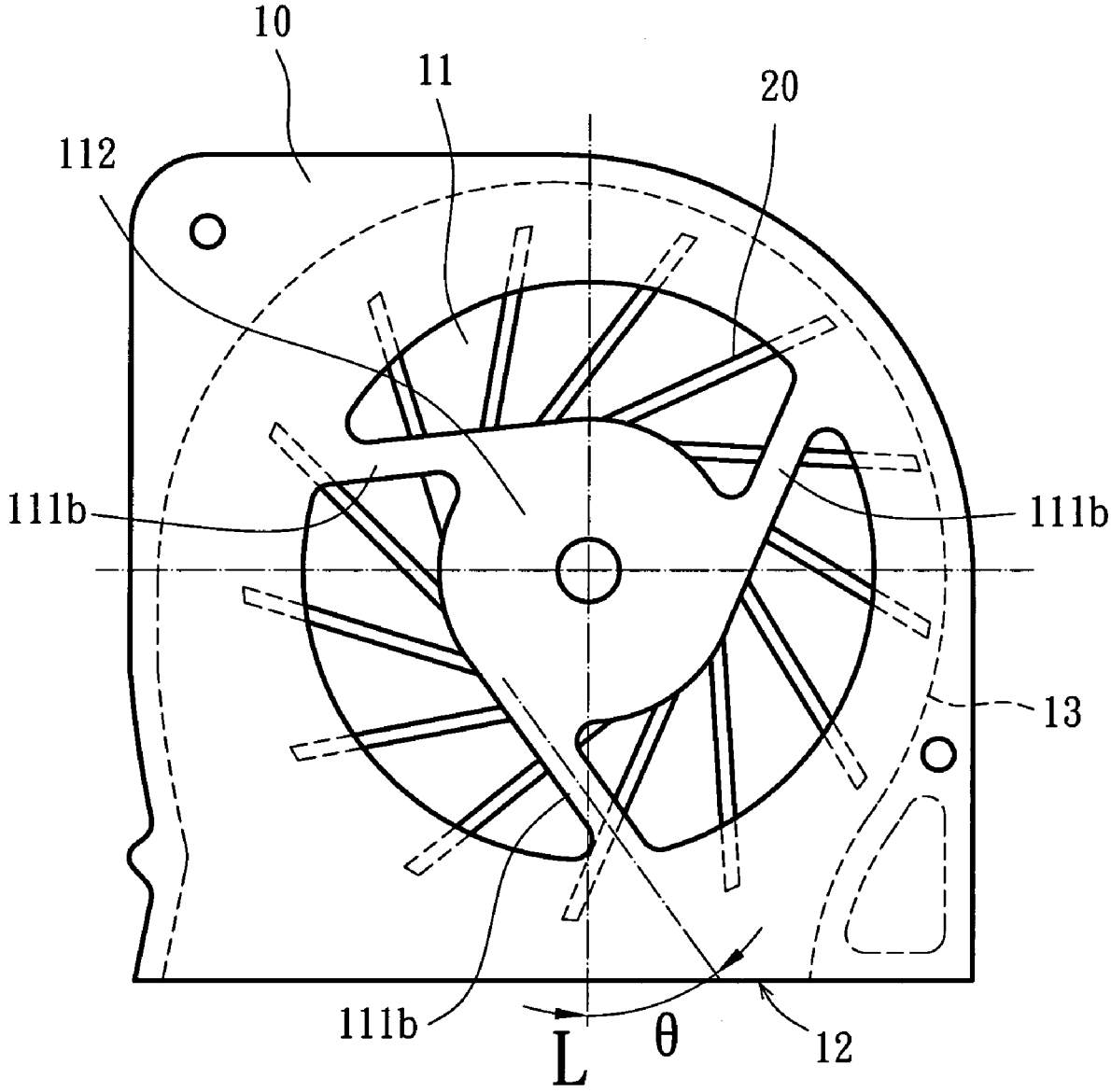
FIG. 3 is a top view of a second embodiment of the fan housing in accordance with the present invention.

FIG. 3 is a top view of a second embodiment of the fan housing in accordance with the present invention. Compared to the first embodiment, the supporting rib 111*b* adjacent to the air outlet 12 intersects with the longitudinal line L and extends in a direction at an inclination angle θ to the longitudinal line L with reference to the air outlet 12. The maximum allowable inclination angle is ±40 degrees (+40 degrees in the embodiment shown).

Figure 4:
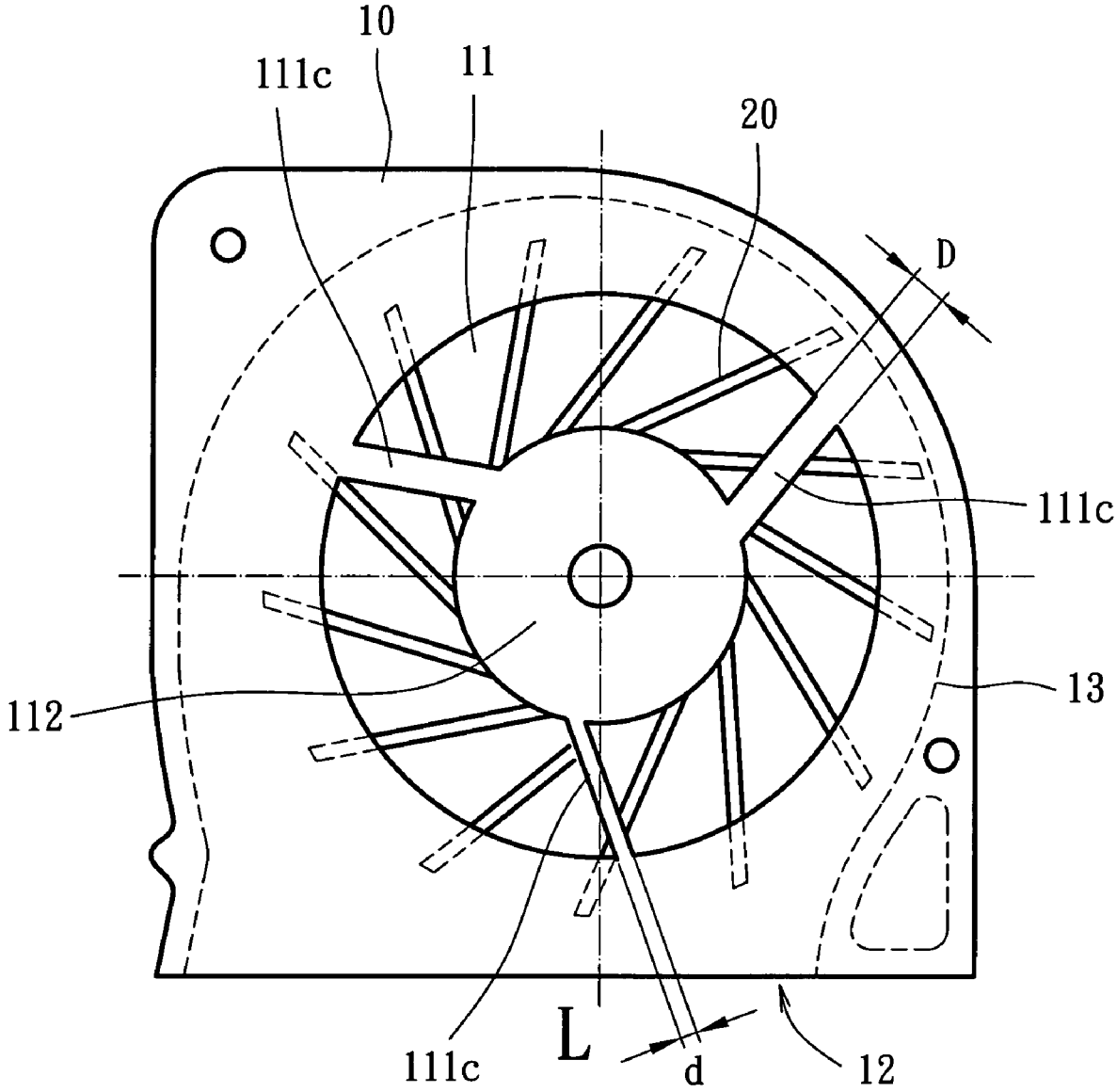
FIG. 4 is a top view of a third embodiment of the fan housing in accordance with the present invention.

FIG. 4 is a top view of a third embodiment of the fan housing in accordance with the present invention. Compared to the first and second embodiments, the width "d" of the supporting rib 111*c* adjacent to the air outlet 12 is smaller than the width "D" of the remaining supporting ribs 111*c*. The supporting rib 111*c* adjacent to the air outlet 12 and having a smaller width "d" effectively reduces the operational noise of the housing 10.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A fan housing with a noise-reducing structure, comprising:

a housing including a side wall;

an air inlet defined in the housing and including an inner periphery and an outer periphery;

an air outlet defined in the side wall of the housing; and a plurality of supporting ribs disposed in the air inlet, the plurality of supporting ribs being connected between the inner periphery and the outer periphery of the air inlet for supporting a motor base, only one of the plurality of supporting ribs being aligned with a longitudinal line of the air outlet which extends through a rotational axis of the motor base, having an extending direction from the motor base to the outlet, and a width smaller than widths of the remaining supporting ribs.

2. The fan housing with a noise-reducing structure as claimed in claim 1, wherein the supporting rib adjacent to the air outlet extends along the longitudinal line in parallel.

3. The fan housing with a noise-reducing structure as claimed in claim 1, wherein the supporting rib adjacent to the air outlet extends in a direction at an inclination angle to the longitudinal line.

4. The fan housing with a noise-reducing structure as claimed in claim 3, wherein the inclination angle is ±40 degrees.

5. A fan housing with a noise-reducing structure, comprising:

a housing including a side wall;

an air inlet defined in the housing and including an inner periphery and an outer periphery;

an air outlet defined in the side wall of the housing; and a plurality of supporting ribs disposed in the air inlet, the plurality of supporting ribs being connected between the inner periphery and the outer periphery of the air inlet for supporting a motor base, the plurality of supporting ribs including a closest rib relative to the air outlet, with the closest rib extending in a direction from the motor base to the outlet and at an inclination angle to a longitudinal line of the air outlet extending through a rotational axis of the motor base, the closest rib having a width smaller than widths of the remaining supporting ribs.

6. The fan housing with a noise-reducing structure as claimed in claim 5, wherein the inclination angle is ±40 degrees.

* * * * *